United States Patent [19]

Tertinek

[11] 3,934,377

[45] Jan. 27, 1976

[54] CONCRETE SURFACE GRINDER

[75] Inventor: Christian T. Tertinek, Canandaigua, N.Y.

[73] Assignee: Stone Construction Equipment, Inc., Honeoye, N.Y.

[22] Filed: June 12, 1974

[21] Appl. No.: 478,728

[52] U.S. Cl. ..... 51/177

[51] Int. Cl.[2] ..... B24B 23/02

[58] Field of Search ..... 51/176, 177

[56] References Cited

UNITED STATES PATENTS

| | | | |
|---|---|---|---|
| 820,751 | 5/1906 | Wattles | 51/176 |
| 2,001,099 | 5/1935 | Holt | 51/176 |
| 2,793,476 | 5/1957 | Lombardo | 51/177 |
| 3,102,372 | 9/1963 | Vezner | 51/177 |
| 3,124,911 | 3/1964 | Vinella | 51/177 |
| 3,504,434 | 4/1970 | Thomsen | 51/177 X |
| 3,552,070 | 1/1971 | Reiss | 51/177 |
| 3,701,221 | 10/1972 | Vinella | 51/177 |

*Primary Examiner*—Donald G. Kelly
*Attorney, Agent, or Firm*—Clarence A. O'Brien; Harvey B. Jacobson

[57] ABSTRACT

A rotary concrete surface grinding and smoothing device having a segmental diamond chip impregnated, engine-driven, rotating grinding head; a foot-operated unit for raising and lowering the grinding head with relation to the surface to be ground; a slanted front end for better visibility; and, ballast weight and adjustable axle means to incrementally vary the downward pressure of the grinding head on the to be ground surface.

8 Claims, 6 Drawing Figures

CONCRETE SURFACE GRINDER

FIELD OF THE INVENTION AND SUMMARY OF THE PRIOR ART

The Mall patents (U.S. Pat. No. 1,980,491, issued Nov. 13, 1934; U.S. Pat. No. 2,097,730, issued Nov. 2, 1937; and U.S. Pat. No. 2,106,033, issued Jan. 18, 1938) all disclose fluid assisted terrazzo grinding devices; the Doran patent (U.S. Pat. No. 3,098,329, issued July 23, 1963) shows mounting and driving means for balanced maneuverability; and, the Highberg patent (U.S. Pat. No. 3,233,369, issued Feb. 8, 1966) and Oswald patent (U.S. Pat. No. 3,745,719, issued July 17, 1973) disclose diamond containing blocks and wheels for grinding.

SUMMARY OF THE INVENTION

Among the objects and advantages of my invention are the following:

1. To provide an improved concrete surface grinding device having a grinding head with a plurality of angularly dispersed, diamond-impregnated blocks as the grinding means.

2. To provide shiftable axle means and changeable ballast weight means to vary the pressure of the device on the surface being ground.

3. To provide various other adjustment and handling means for shifting the entire device from one area to another including a foot-operated means for raising and lowering the grinding head and including an adjustable leg assembly to assure that the grinding head properly clears the surface when elevated.

4. To provide such further features to aid visibility, simplify maintenance, and to produce a rugged, yet economical unit.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 4:
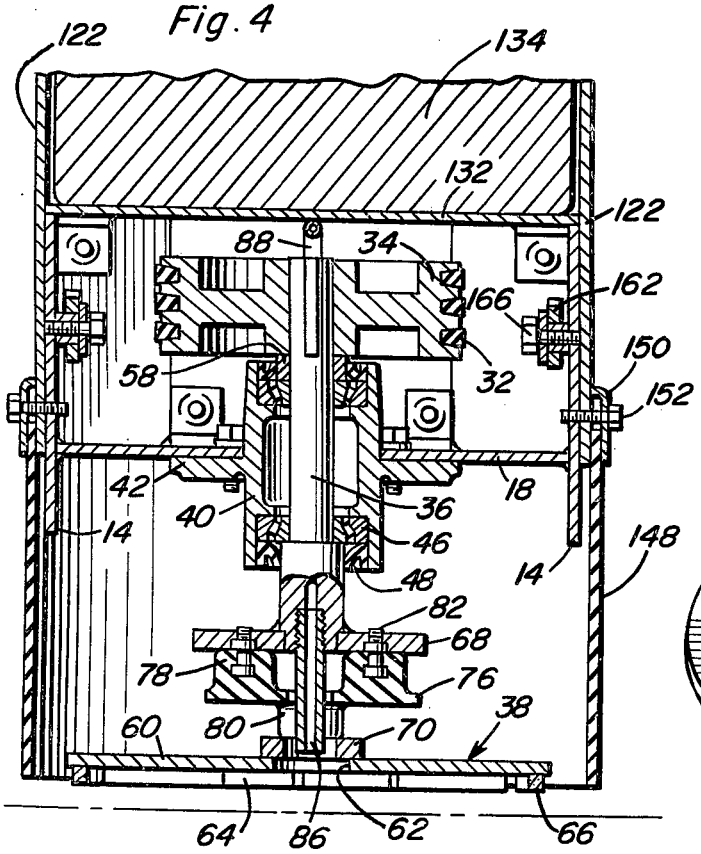
FIG. 4 is a transverse sectional view taken approximately along the line 4—4 of FIG. 3.

The surface grinder of the present invention is generally designated by reference numeral 10 and includes a main frame generally designated by numeral 12 and which includes a pair of substantially parallel longitudinally extending plate members 14 along each side of the grinder which are vertically oriented and retained in rigid relationship by a transverse rear plate 16 which is vertically disposed and a transverse forward horizontal plate 18 with the plate 18 being oriented intermediate the top and bottom edges of the side frame members 14 but closer to the bottom as illustrated in FIG. 4. The members 14, 16 and 18 are secured together by suitable welding or the like thus providing a rigid frame 12 which supports a suitable internal combustion engine 20 or the like intermediate the ends thereof which is supported on a transverse supporting plate 22 rigidly fixed between the side frame members 14 with the engine 20 including a mounting base 24 secured to the plate 22 by suitable bolts 26 extending through slots in the plate 22 in a well known manner for enabling limited adjustment of the position of the engine for varying the tension on drive belts in a manner well known in the art. The engine 20 may be any suitable horsepower, air-cooled gasoline engine or equivalent power device.

The engine 20 is provided with an output shaft 28 which depends through an opening in the plate 22 and the output shaft 28 is provided with a multi-groove drive pulley 30 keyed thereto and secured thereto in any suitable manner with the drive pulley 30 receiving and driving a plurality of V-belts 32. The V-belts 32 extend forwardly and encircle a large multi-groove pulley 34 keyed to the upper end of a vertically disposed shaft 36 which has a grinding head generally designated by the numeral 38 on the lower end thereof for driving the grinding head in a rotatable manner about a substantially vertical axis from the engine 20.

The vertical shaft 36 is rotatably supported from the plate 18 by a cylindrical bearing housing 40 having a flange 42 bolted thereto by suitable bolts 44 or the like. At the upper and lower end of the bearing housing 40, there is provided a roller bearing assembly 46 and a grease seal 48 outwardly thereof which provides a seal for the hollow interior 50 of the housing 40 to provide a reservoir for lubrication material such as a suitable grease which is injected into the space 20 through a suitable lubrication fitting 52. As illustrated, the shaft 36 is provided with an enlarged lower end portion 54 defining a shoulder 56 which engages the bearing 46 and a similar shoulder 58 is provided on the shaft 36 engaging the upper bearing 46 to retain the shaft 36 rotatably supported by the bearing assemblies with the upper shoulder 58 being rigidly secured in position such as by press-fitting or any suitable fastening means so that the upper shoulder 58 can be removed for assembly and disassembly and repair, if necessary.

Figure 5:
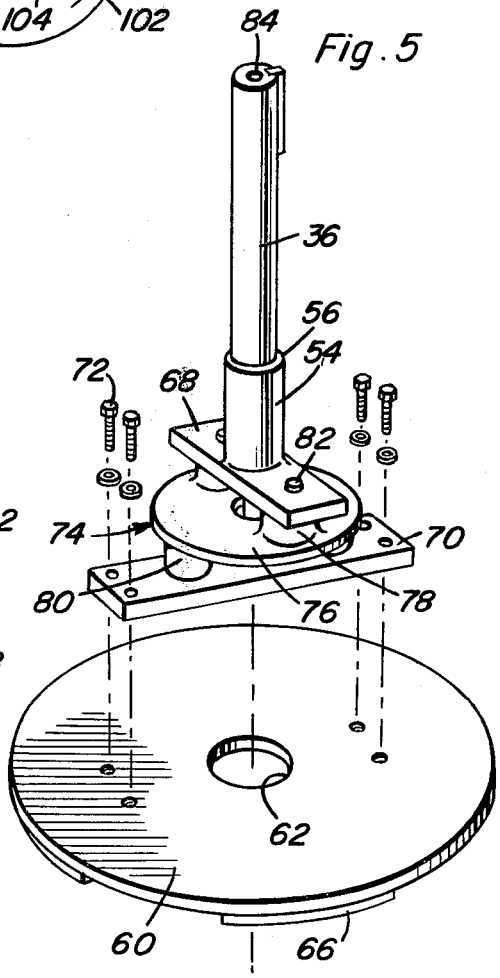
FIG. 5 is an exploded perspective view of the grinding head and its supporting structure.
Figure 2:
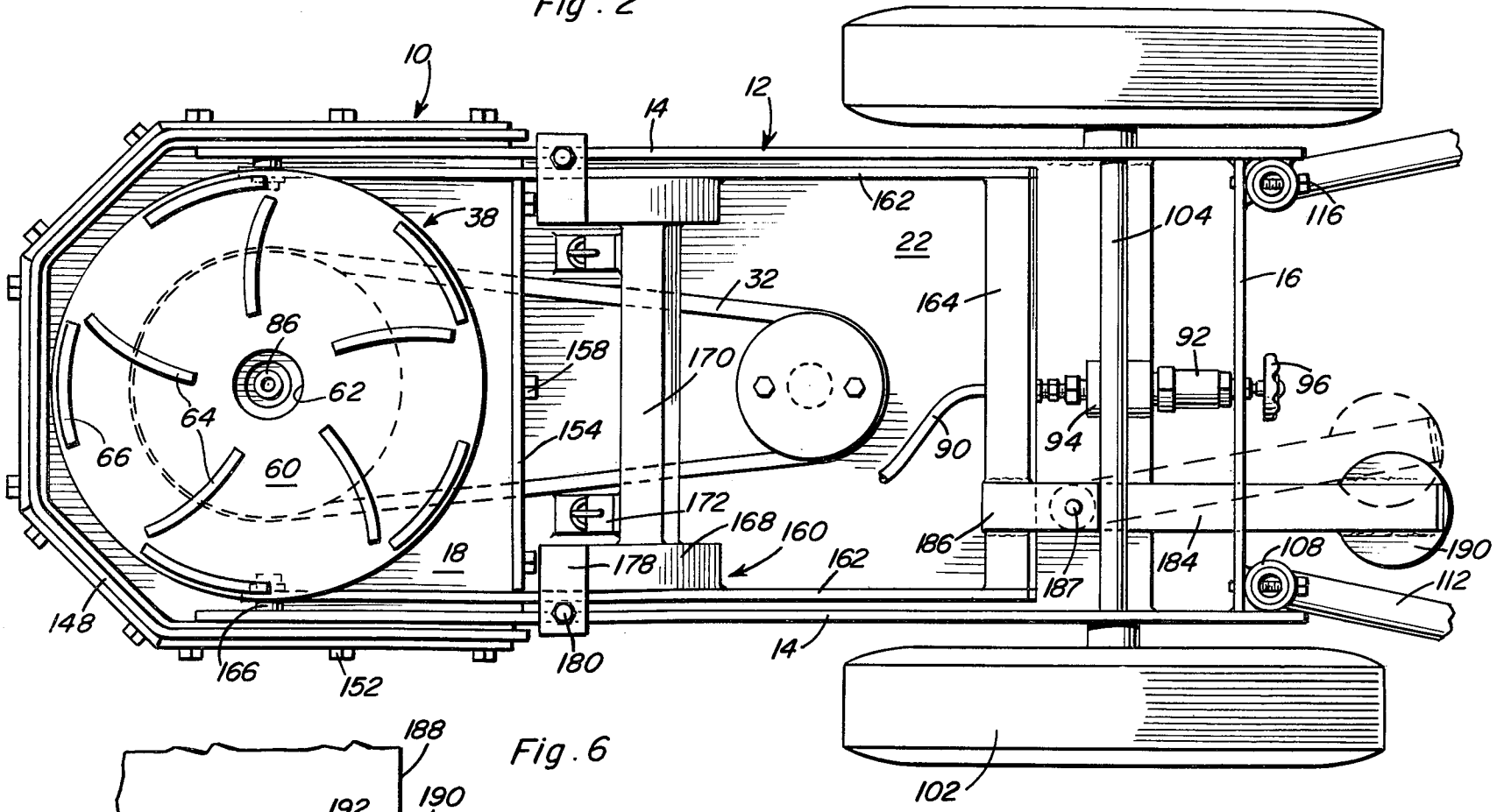
FIG. 2 is a bottom plan view showing the surface of the ten-segment grinding head.
Figure 6:
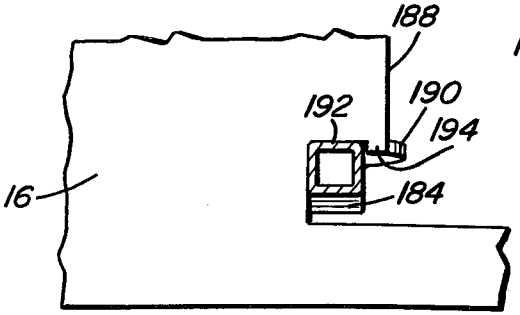
FIG. 6 is a sectional view taken approximately along the line 6—6 of FIG. 3 illustrating the foot pedal latch structure.

The grinding head 38 includes a circular disc 60 having a central opening 62 therein as illustrated in FIG. 5 and a plurality of arcuate and angularly displaced diamond impregnated grinding blocks 64 mounted radially on the undersurface thereof together with a plurality of circumferentially arranged blocks 66 adjacent the periphery of the plate 60 on the undersurface thereof as illustrated in FIGS. 2 and 4. As illustrated, there are ten block segments 64 and 66 secured to the disc but this number may vary and the specific arrangement thereof may vary but preferably, the arrangement is in the pattern illustrated so that the blocks will tend to wipe material away from the area being ground.

The plate 60 is mounted to the shaft 36 by a relatively narrow rectangular mounting plate 68 rigidly fixed to the lower end of the shaft 36 as by welding or the like and a similarly shaped plate 70 in perpendicular relation to the plate 68 and spaced therefrom with the plate 70 being secured to the disc 60 by suitable fasteners 72. Interposed between the plates 68 and 70 is a flex coupling generally designated by numeral 74 and which includes a central plate 76 with a pair of upwardly projecting mounting bosses 78 on the upper surface and a pair of downwardly projecting mounting bosses 80 on the lower surfaces with the bosses being staggered in relation to each other and with the two upper bosses 78 underlying and being secured to the plate 68 by fasteners 82 and the bosses 80 overlying the plate 70 and being secured thereto in a similar manner thereby providing a degree of flexibility for the grinding head 38 so that the plate or disc can assume a relation parallel to the surface being ground.

Figure 1:
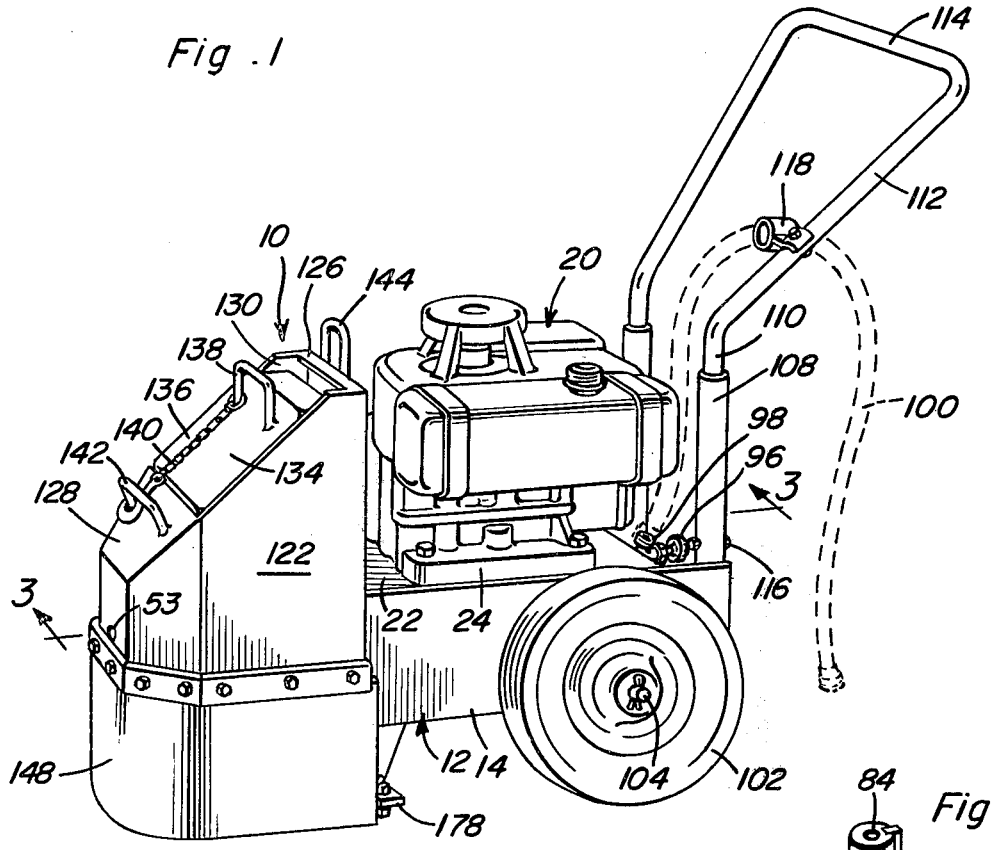
FIG. 1 is a perspective view of the device.
Figure 3:
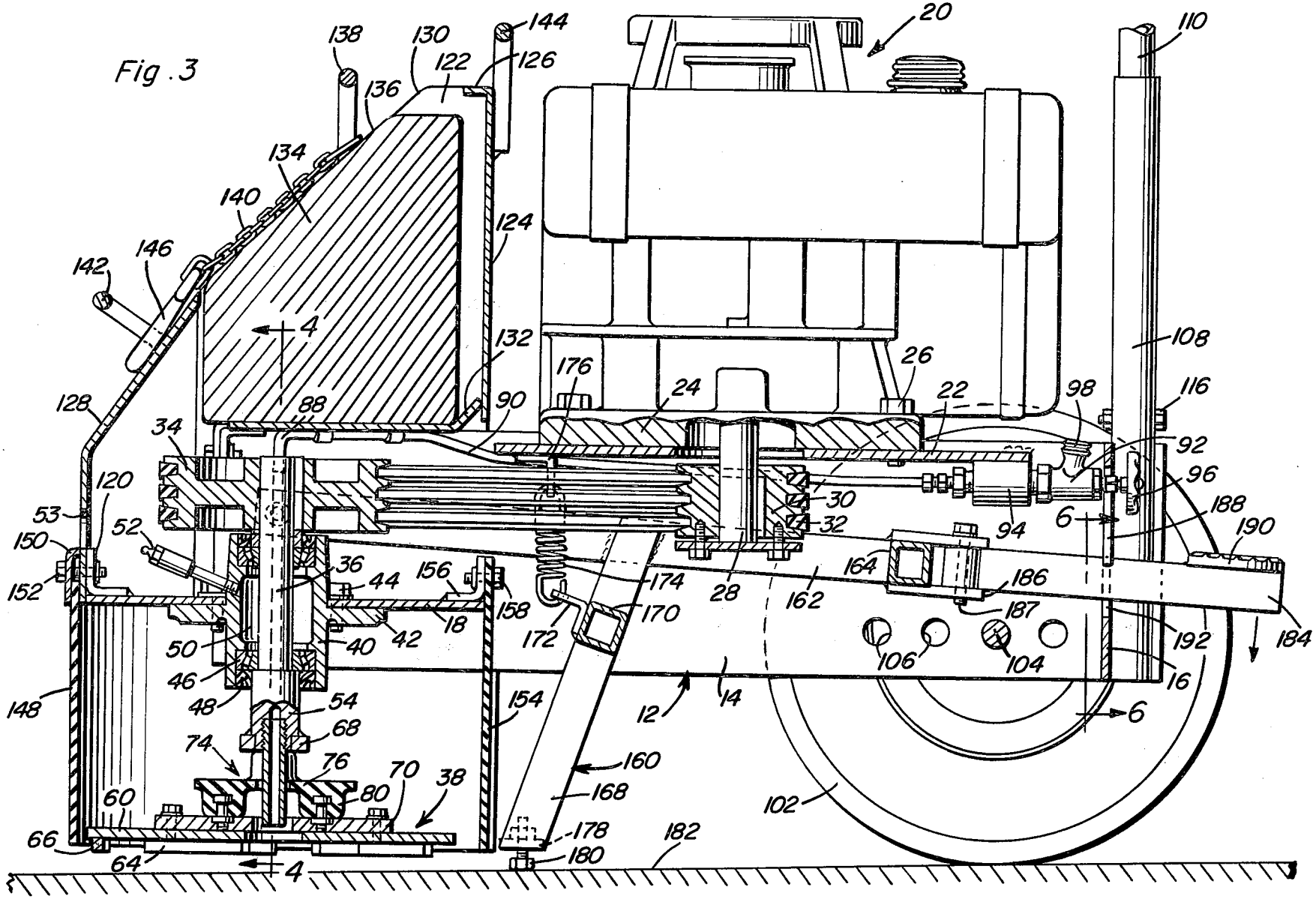
FIG. 3 is a longitudinal sectional view taken approximately along the line 3—3 of FIG. 1.

The shaft 36 is hollow as indicated by numeral 84 and the lower end of the shaft is provided with a pipe nipple 86 which extends down through a hole in the center of the flex coupling and a corresponding hole in the mounting plate 70 which is in alignment with the opening 62 in the disc 60 thus discharging fluid onto the surface area being ground. The upper end of the hollow shaft 36 telescopically receives the depending end 88 of a tube 90 which is stationary in relation to the shaft 36 and extends rearwardly and is connected to a valved inlet fitting 92 through a supporting adapter 94 attached to the bottom of the underside of the plate 22 as illustrated in FIG. 3. A handle 96 is provided for the valved inlet 92 and a threaded male fitting 98 is also provided thereon for connection to a water supply hose 100 as illustrated in FIG. 1 which is communicated with a suitable source of water or other liquid solution used on the surface to be ground.

For supporting the grinder 10, a pair of pneumatic wheel assemblies 102 are provided and oriented along opposite sides of the frame 12 with the wheels 102 being interconnected by an axle 104 that is inserted in one of a plurality of longitudinally spaced pairs of holes 106 in order to vary the point of support of the frame longitudinally of the frame. At the rear of the side frame members 14, there is provided a vertical tubular socket 108 at each side of the frame which may be conveniently welded in the angular area between the rear ends of the frame members 14 and the transverse rear plate 16 with the upper ends of the sockets 108 extending substantially above the side members 14. Telescopically received in the sockets 108 are downwardly extending handle members 110 which have their main portions 112 extending rearwardly and upwardly in a diverging relation and interconnected by a transverse member 114 to enable manipulative control of the surface grinder 10. The handle members 110 are secured in the sockets 108 by fastening bolts 116 or the like and one of the handle members 112 may be provided with a clamp bracket 118 to support the water hose 100 as illustrated in FIG. 1. Thus, by pushing downwardly on the transverse handle 114, the surface grinder may be pivoted about the supporting wheels 102 and rolled to a desired surface or otherwise manipulated during the grinding operation.

The plate 18 which supports the shaft 36 and bearing housing 40 includes a plurality of right-angled mounting lugs 120 thereon which support a vertically disposed tubular housing 122 which includes a rear wall 124, a partial top wall 126 which is substantially horizontal and a partial slanted top wall 128 which defines an enlarged opening 130 between the front edge of the partial top wall 126 and the rear edge of the slanted wall 128 with this opening having a supporting bottom plate 132 spaced downwardly from the opening 130 and provides a support for a ballast weight 134 which is removable through the opening 130 for enabling various weights to be inserted into the opening 130. The weight 134 is also provided with a slanted top surface 136, a U-shaped loop handle 138 thereon and a tether chain 140 connected thereto with the other end of the tether chain adapted to be connected with a loop 142 on the front wall 128 or a loop 144 on the rear wall 124. The chain 140 may be provided with a snap hook 146 on the end thereof to prevent loss of the ballast weight 134 with the size and configuration as well as the weight of the ballast weight being variable with the weight either being of one piece construction or of multiple piece construction. The slanted construction of the top wall 136 on the weight and the wall 128 provides for better observation of the surface area immediately in front of the surface grinder by the operator of the grinder who would normally be standing behind the grinder and grasping the handle 114 thereby providing for more accurate control and more effective use of the grinder. The front of the housing 122 as well as the front of the plate 18 is of polygonal construction and tapered to further enhance visibility of the area around the front of the surface grinder.

A depending flexible skirt 148 is attached to the lower edge of the housing 122 by clamping plate members 150 and fastening bolts 152 with the bottom edge of the skirt 148 being substantially in alignment with the disc 60 and slightly above the bottom edges of the grinding blocks 64 and 66. The skirt 148 is of generally U-shaped configuration with the rear edges thereof terminating generally in alignment with the rear edge of the housing 122. Extending transversely behind the grinding head 38 is a straight depending skirt 154 attached to a mounting clip 156 by fasteners 158 as illustrated in FIG. 3. Thus, the flexible skirts 148 and 154 completely encircle the rotating grinding head 38.

A foot pedal and leg assembly generally designated by numeral 160 is provided for supporting the grinding head in elevated position which includes a pair of side members or levers 162 which are parallel to the frame members 14 and disposed slightly inwardly thereof with the rearward ends of the levers being rigidly interconnected by a rear transverse member 164 and the forward ends of the levers being pivotally supported from the side frame members 14 by a pivot bolt and bushing assembly 166. Each lever 162 is provided with a depending and forwardly inclined leg 168 intermediate the ends thereof with the lower end of each leg 168 being disposed slightly rearwardly of the rear skirt 154 as illustrated in FIG. 3. The legs 168 are interconnected at their intermediate portion by a transverse brace member 170 to provide a rigid leg structure. A pair of spring clips are mounted on the brace 170 are designated by numeral 172 with a tension coil spring 174 being connected to each of the spring clips 172 and having upper ends connected to spring clips 176 attached to the underside of the plate 22 adjacent the forward end thereof thus biasing the legs 168 upwardly and biasing the entire assemby upwardly about the transverse pivot axis defined by the bushing and bolt assemblies 166. The lower end of each leg 168 is provided with a laterally outwardly extending foot 178 having an adjustable bolt 180 associated therewith in which the bolt head provides engagement with a supporting surface 182 which is the surface being ground and which provides a support for the surface grinder when the grinding head 38 is in elevated position as illustrated in FIG. 3 with the adjustable bolts 180 being provided to assure that the grinding head is elevated above the surface 182 when the leg and pedal assembly 160 is swung downwardly to a latched position about the pivot axis defined by the bolt and bushing assemblies 166.

For swinging the assembly 160 downwardly, a foot pedal 184 is attached to the transverse member 164 by a pair of lugs 186 and a vertical pivot bolt 187 extending therebetween. The foot pedal 184 extends rearwardly through a notch 188 provided in the transverse rear plate 16 so that the foot pedal 184 may swing vertically when pressure is exterted on a pad 190 provided on the pedal 184 or when pressure is removed therefrom. In the position in FIG. 3, the foot pedal 184 has been pivoted downwardly thus elevating the grinding head 38 above the surface 182. If this position is desired to be maintained, the vertical bolt 187 enables the foot pedal 184 to be swung laterally out of registry with the vertical notch 188 into a recess 192 in one edge of the notch which has a depending lug 194 at the top inner corner thereof which serves as a latch structure for retaining the foot pedal 184 in depressed position thus retaining the grinding head 38 in elevated position. When it is desired to lower the grinding head 38 into contact with the surface 182, the foot pedal 184 is depressed slightly and then moved laterally into registry with the vertical slot-like opening 188 in the plate 16 with its upward movement raising the bolts 180 out of engagement with the surface 182 due to the tension of the springs 174.

With this construction, the surface grinder can be easily lowered so that the grinding head will engage the surface to be ground and it can just as easily be raised with the bolt adjustment compensating for grinding block wear since it is only necessary to elevate the grinding head slightly away from the surface. The ballast weight 134 can be removed and replaced with other weights or removed all together and by varying the position of the axle 104, the downward pressure exerted on the grinding head may be incrementally varied. The slanted front end of the housing or cowl together with the slanting surface on the weight provides for better observation of the work area and the one point lubrication fitting 52 which is accessible through a hole 53 in the front of the housing 122 facilitates lubrication of the supporting bearing structure for the grinding head which is the only wear point in the device thus facilitating lubrication and increasing longevity of the bearing assembly.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. In a surface grinder, the combination of a wheeled undercarriage having an axle positionable in one of a plurality of longitudinally spaced pairs of apertures in a frame portion of said undercarriage, a grinding wheel carried by said undercarriage, said undercarriage further carrying a skirt means surrounding the periphery of said grinding wheel, handle means and fluid supply means extending from a rearward portion of the grinder, hollow spindle means connected to the fluid supply means and to further conduit means, said hollow spindle means mounting the grinding wheel on the undercarriage, said grinding wheel including a plurality of diamond impregnated blocks mounted on the undersurface thereof, further conduit means connecting said fluid supply means, via the hollow spindle means, with an aperture in a central portion of said grinding wheel to supply fluid thereto, a power source and drive train including belt means and sheaves for rotatably driving said grinding wheel, changeable weight means on the undercarriage to vary the pressure between the grinding wheel and the surface to be ground, a housing for the grinding wheel having a frontal portion that slants from the power source area downwardly toward the forward portion of the grinder to increase visibility for an operator, said skirt means blending with said downwardly inclined housing and surrounding said weight means, a foot-operated lever means on said undercarriage to assist an operator in elevating the grinding wheel and changing the direction in which the grinder is being moved over the surface being ground, said lever means including adjustable threaded leg elements for varying the spacing of the grinding wheel from the to-be-ground surface.

2. The structure as defined in claim 1 wherein said grinding wheel is in the form of a disk having said blocks on the undersurface thereof, and a flex coupling means interconnecting said disk and said spindle means, said flex coupling means including a plate of resilient material having mounting bosses extending from opposite surfaces thereof with the depending bosses being connected to the disk and the upstanding bosses being connected to the spindle means.

3. The structure as defined in claim 2 wherein said undercarriage includes a generally horizontally disposed supporting plate, lubricated bearing means supported by said plate and rotatably journaling said spindle means for rotation about a generally vertical axis, said undercarriage including means adjacent the rear thereof for engagement with the lever means for releasably retaining the lever means in depressed position for elevating the grinding wheel from a surface.

4. A surface grinder comprising a frame, a pair of supporting wheels supported from said frame for rolling engagement with a supporting surface, a surface grinding head rotatably supported from said frame, said grinding head being spaced longitudinally from said wheels and disposed below the frame for engaging a work surface, drive means mounted on said frame and connected with said grinding head for rotatably driving said grinding head, handle means on said frame adjacent the wheels and spaced therefrom opposite to the grinding head whereby downward force exerted on the handle means will fulcrum the frame about the wheels and elevate the grinding head from the work surface to enable manual manipulation of the grinder on the supporting surface, said drive means including a prime mover mounted on the frame forwardly of the wheels whereby the grinding head is urged downwardly toward the work surface about the wheels by the combined weight of the frame, prime mover and grinding head, said frame being provided with an elongated lever pivoted thereon forwardly of the wheels and including a swingable rearward end extending rearwardly from the frame, a foot pedal mounted on the rearward end of the lever and being accessible to an operator of the grinder, and depending leg means on said lever forwardly of the wheels with the lower end of the leg means terminating adjacent the work surface when the lever is in its uppermost position with the leg means moving downwardly when the foot pedal is depressed for elevating the forward end of the lever and the forward end of the frame and grinding head from the work surface.

5. The structure as defined in claim 4 wherein said leg means includes a pair of legs, each of the legs having a vertically adjustable member at the lower end thereof to assure clearance of the grinding head above the work surface when the foot pedal is depressed, spring means biasing said lever toward its upper position, and latch means on said frame for releasably retaining said lever in its lower position so that the lever will retain the grinding head elevated from the work surface without attendance by an operator.

6. A surface grinder comprising a frame, a pair of supporting wheels supported from said frame for rolling engagement with a supporting surface, a surface grinding head rotatably supported from said frame, said grinding head being spaced longitudinally from said wheels and disposed below the frame for engaging a work surface, drive means mounted on said frame and connected with said grinding head for rotatably driving said grinding head, handle means on said frame adjacent the wheels and spaced therefrom opposite to the grinding head whereby downward force exerted on the handle means will fulcrum the frame about the wheels and elevate the grinding head from the work surface to enable manual manipulation of the grinder on the supporting surface, said drive means including a prime mover mounted on the frame forwardly of the wheels whereby the grinding head is urged downwardly toward the work surface about the wheels by the combined weight of the frame, prime mover and grinding head, said grinding head including a generally vertically disposed spindle, bearing means rotatably supporting said spindle from the frame, a generally horizontally disposed grinding disk, and means connecting said disk to the lower end of said spindle including a flexible coupling means to enable the disk to flex into substantially parallel relation to the work surface, said frame being provided with a housing at the forward end thereof spaced from said wheels, said housing including an open lower end spaced above said disk, a depending flexible skirt mounted on said housing and depending into encircling relation to the disk for retaining material peripherally of the disk, said housing including an upwardly opening receptacle, weight means removably positioned in said receptacle for enabling increase or decrease of the pressure exerting downwardly on the grinding head, said disk including spaced blocks of abrasive material on the undersurface thereof for engagement with the work surface, the upper end of said housing and weight means being inclined downwardly and forwardly to enable observation of the work surface adjacent the grinding head by an operator positioned at the opposite end of the grinder adjacent the handle means.

7. The structure as defined in claim 6 wherein said frame is provided with an elongated lever pivoted thereon forwardly of the wheels and including a swingable rearward end extending rearwardly from the frame, a foot pedal mounted on the rearward end of the lever and being accessible to an operator of the grinder, and depending leg means on said lever forwardly of the wheels with the lower end of the leg means terminating adjacent the working surface when the lever is in its uppermost position with the leg means moving downwardly when the foot pedal is depressed for elevating the forward end of the lever and the forward end of the frame and grinding head from the work surface, said leg means includes a pair of legs, each of the legs having a vertically adjustable member at the lower end thereof to assure clearance of the grinding head above the work surface when the foot pedal is depressed, spring means biasing said lever toward its upper position, and latch means on said frame for releasably retaining said lever in its lower position so that the lever will retail the grinding head elevates from the work surface without attendance by an operator, said spindle including a hollow central portion communicating with the underface of the disk, the upper end of the hollow spindle being connected to fluid supply means for supplying fluid to the work surface.

8. A surface grinder comprising a frame, supporting wheels supported from said frame for rolling engagement with a supporting surface, a surface grinding head rotatably supported from said frame, said grinding head being disposed below the frame for engaging a work surface, drive means mounted on said frame and connected with said grinding head for rotatably driving said grinding head, handle means on said frame to enable manual manipulation of the grinder on the supporting surface, said drive means including a prime mover mounted on the frame whereby the grinding head is urged downwardly toward the work surface by the combined weight of the frame, prime mover and grinding head, said frame being provided with an elongated lever pivoted thereon and including a swingable rearward end extending rearwardly from the frame, a foot pedal mounted on the rearward end of the lever and being accessible to an operator of the grinder, and depending leg means on said lever with the lower end of the leg means terminating adjacent the work surface when the lever is in its uppermost position with the leg means moving downwardly when the foot pedal is depressed for elevating the grinding head from the work surface, said frame being provided with a housing including an open lower end spaced above said grinding head, a depending flexible skirt mounted on said housing and depending into encircling relation to the guiding head for retaining material peripherally thereof, said housing including an upwardly opening receptacle, weight means removably positioned in said receptacle for enabling increase or decrease of the pressure exerting downwardly on the grinding head, the upper end of said housing and weight means being inclined downwardly and forwardly to enable observation of the work surface adjacent the grinding head by an operator positioned adjacent the handle means.

* * * * *